US008075415B2

(12) United States Patent
Owen et al.

(10) Patent No.: US 8,075,415 B2
(45) **Date of Patent: *Dec. 13, 2011**

(54) CUE STICK AND CUE STICK HANDLE WITH RIGID INNER CORE AND METHOD OF MAKING THE SAME

(75) Inventors: Donald W. Owen, Rowlett, TX (US); Eldon Royce Bunnell, The Colony, TX (US)

(73) Assignee: OB Cues, Inc., Plano, TX (US)

( * ) Notice: Subject to any disclaimer, the term of this patent is extended or adjusted under 35 U.S.C. 154(b) by 102 days.

This patent is subject to a terminal disclaimer.

(21) Appl. No.: 12/259,047

(22) Filed: Oct. 27, 2008

(65) Prior Publication Data

US 2009/0111596 A1 Apr. 30, 2009

Related U.S. Application Data

(60) Provisional application No. 60/982,881, filed on Oct. 26, 2007.

(51) Int. Cl.
*A63D 15/08* (2006.01)

(52) U.S. Cl. ..... 473/44; 473/47

(58) Field of Classification Search ..... 473/44–51
See application file for complete search history.

(56) References Cited

U.S. PATENT DOCUMENTS

| | | | | | |
|---|---|---|---|---|---|
| 711,906 | A * | 10/1902 | Lyon | 473/44 |
| 951,453 | A * | 3/1910 | Ransom | 473/44 |
| 1,007,668 | A * | 11/1911 | Barrows | 473/44 |
| 1,505,609 | A * | 8/1924 | Barach et al. | 473/44 |
| 1,527,748 | A * | 2/1925 | Rambow | 473/47 |
| 1,702,292 | A * | 2/1929 | Barrett | 473/44 |
| 3,232,613 | A * | 2/1966 | Laube, Jr. | 473/47 |
| 5,518,455 | A * | 5/1996 | Costain et al. | 473/44 |
| 2002/0072424 | A1 * | 6/2002 | Yu | 473/44 |
| 2003/0153393 | A1 * | 8/2003 | Chang | 473/44 |
| 2003/0224865 | A1 * | 12/2003 | Lai | 473/44 |
| 2007/0123362 | A1 * | 5/2007 | Marino | 473/44 |
| 2008/0026861 | A1 * | 1/2008 | Costain et al. | 473/44 |

* cited by examiner

*Primary Examiner* — Mark Graham
(74) *Attorney, Agent, or Firm* — Yudell Isidore Ng Russell PLLC

(57) ABSTRACT

A cue stick handle includes: an exterior casing of conical members; a rigid inner core, which includes linearly interlocked and glued components, including (a) a rigid tube composed of a hard, tensile material that provides steel-like characteristics, including rigidity and stiffness and (b) a pin holder composed of a strong composite or plastic material, having a high tensile and high bending strength, and adhesively coupled to the tube. The first end of a joint pin is securely inserted within the pin holder and a second end of the joint pin extends in an axial direction away from the tube. The tube is filled with a vibration-dampening, foam-like material. The rigid inner core may include a wood core securely mated to an end of the rigid tube. A pair of collars is coupled to each end of the rigid inner core to secure the rigid inner core inside the exterior casing.

12 Claims, 5 Drawing Sheets

CUE STICK AND CUE STICK HANDLE WITH RIGID INNER CORE AND METHOD OF MAKING THE SAME

PRIORITY CLAIM

The present application claims benefit of U.S. Provisional Application Ser. No. 60/982,881, filed Oct. 26, 2007, titled "Cue Stick, Cue Stick Handle And Method Of Making The Same," the contents of which is incorporated herein by referenced in its entirety.

RELATED APPLICATIONS

The present invention is related to the subject matter of the following commonly owned, co-pending U.S. patent application, having Ser. No. 12/258,986 and filed on even date herewith.

BACKGROUND OF THE INVENTION

1. Field of the Invention

The illustrative embodiment of the present invention relates generally to cue sticks and specifically to an improved cue stick, cue stick handle and design thereof.

2. Description of the Related Art

A cue stick for playing pool or billiards or similar games in that genre is an elongated tapered shaft with a handle at one end and a tip at the other end. The cue stick can be integrally formed or made of two or more members engaged together along a linear axis. For example, the cue stick may be made of a cue shaft portion, complete with a tip for striking the balls, and a base or handle portion to provide the length and balance to the shaft portion. The two portions are secured at a joint, which allows the user to separate the two portions for ease in carrying and storing the cue stick. Typically, joints are bolt-type couplings with a screw mechanism (or pin), allowing the handle to be readily engaged and disengaged from the cue shaft.

One common fault observed in this existing design is the weakness of the joint at which the cue shaft connects to the handle. With conventional two or three piece cue sticks, the joint connecting the shaft to the handle are typically weak and are prone to breaking or splitting when exposed to lateral or bending stress.

In order to provide optimum performance, a cue stick needs to have a rigid handle section and have a preferably perfectly straight axis. It is also desirable for the cue stick to generate minimal vibration when striking a cue ball, and to provide a radially consistent "feel" and performance regardless of the orientation or rotation of the cue stick in the player's hand. However, another fault common to most conventional cue sticks is the lack of sufficient rigidity in the handle between the cue shaft and the point at which the player holds the handle. This lack of rigidity occurs because, generally, most professional grade cue sticks and/or cue handles are made of hardwood, such as hard maple, which tends to be less rigid than would be optimal for the cue handle.

Most design improvements in cue sticks have focused on improving the cue shaft, since it is the shaft that strikes the balls and needs to exhibit certain bend and response characteristics when the ball is struck. Consequently, most cue shafts are light weight and have a certain amount of flexion at the tip end in order to provide for better playability on the cue ball.

However, several of the performance characteristics of importance to a cue stick, e.g., weight and balance (or center of gravity) and rigidity, are determined by the handle. These characteristics also add to the good "feel" of a cue stick. Given the desire for a lighter cue shaft, characteristics of weight and balance and rigidity are primarily addressed in the cue handle. Several designs exist that enable a user to add weight to the cue stick after the stick is manufactured. For example, U.S. Patent Application 2002/0072423 provides a cue stick with a "weight slot" in the handle segment in which removable weights may be added to adjust the overall weight of the stick. Still other methods exist, such as sliding and/or attaching weight rings on to the outer circumference of the handle, to enable addition of a desired weight to the cue stick. Changes to the weight, balance, flex and overall operational characteristics of a cue stick are conventionally accomplished by insertion of weights, stiffening members such as inlays or spliced-in "points" in the forearm, and spacer material.

While these prior art methods enable the addition of weight to the cue stick, the weight is typically added in a manner that results in a weight distribution and a center of mass that are less desirable. Additionally, the single focus on adding weight to the stick requires a post-manufacture "fix" or enhancement of the cue stick to attempt to slightly improve the overall playability of the cue stick.

SUMMARY OF THE CLAIMED SUBJECT MATTER

Disclosed are an improved cue stick, cue stick handle (cue handle) and a method and system for making the improved cue stick and cue handle. The cue stick handle comprises: an exterior casing comprising one or more rigid, conical members; an inner core within the external casing and which is confined between the ends of the exterior casing. The inner core comprises a rigid segment (rigid inner core) that provides rigidity to at least a forearm section of the cue handle. The rigid segment of the inner core is made of a material with very high rigidity, while other segments/sections of the inner core exhibit different functional characteristics. The cue handle construction provides rigidity to the cue handle, as well as optimal weight and balance, with effective mass distribution for an optimal effective center of mass, to a resulting cue stick, which is assembled by adjoining the cue handle to a cue shaft.

In a first embodiment, the inner core includes: at least one rigid component providing a first end and a second end opposed to the first end; and a joint pin having a first end securely inserted into the second (anterior) end of the rigid segment of the inner core. The joint pin has a second end extending externally from the second end of the rigid segment of the inner core and is utilized as a connection mechanism for adjoining a cue shaft to the cue handle. A pair of collars is coupled to each end of the inner core to secure the inner core inside of the exterior casing.

According to one embodiment, the inner core is made up of: at least one rigid tube composed of a hard, tensile material that provides steel-like characteristics, including rigidity/stiffness; and a pin holder composed of a strong composite or plastic material, having a high tensile and high bending strength, and which is adhesively coupled via a first extended surface inside a first end of the tube. The pin holder also provides a second, extended surface opposed to the first extended surface, and which extends in an axial direction away from the tube. The first end of the joint pin is securely inserted within the pin holder (longitudinally from the second extended surface through the first extended surface).

In one embodiment, the rigid tube (composed of hard, tensile material) is perforated (with holes) to reduce the effects of weight due to the density of the material, while providing effective mass distribution for an optimal, effective center of mass. The perforated design of the tube enables greater control in the weight per section of the tube and ultimately enables the cue handle to be designed with different exterior material, and provides greater flexibility in providing balance of the cue stick, with effective mass distribution for an optimal, effective center of mass, and other functional benefits, while maintaining the rigidity of the forearm section.

In yet another embodiment, a vibration damping material is inserted into the inner bore of the rigid tube, thereby reducing vibrations along the longitudinal plane when the cue stick is utilized to strike a cue ball.

All objects, features, and advantages of the present invention will become apparent in the following detailed written description.

BRIEF DESCRIPTION OF THE DRAWINGS

This invention is described with illustrative embodiments in the following specification with reference to the drawings, in which like numbers represent the same or similar elements, as follows.

DETAILED DESCRIPTION OF ILLUSTRATIVE EMBODIMENTS

Figure 1:
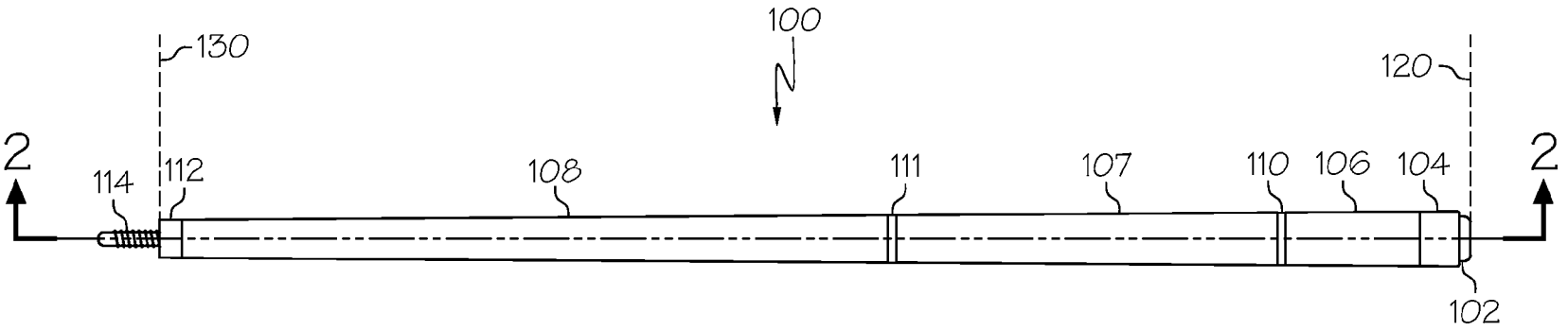
FIG. 1 is an external/perspective view of an example cue handle, designed according to embodiments of the invention.

The illustrative embodiments provide a method, system and cue handle design that provides optimal weight and balance to the cue stick, including effective mass distribution for an optimal center of mass, while ensuring other desired qualities, including: a high level of rigidity in the forearm; increased strength in the joint that connects the cue handle to the cue shaft to prevent or substantially eliminated/reduce breakage at the joint; vibration-dampening within the handle itself, predictable weight and center of gravity; and ease of assembly during manufacture. These and other beneficial properties are associated with the cue handle and cue stick described herein.

In the following detailed description of exemplary embodiments of the invention, specific exemplary embodiments in which the invention may be practiced are described in sufficient detail to enable those skilled in the art to practice the invention, and it is to be understood that other embodiments may be utilized and that architectural, mechanical, and other changes may be made without departing from the spirit or scope of the present invention. The following detailed description is, therefore, not to be taken in a limiting sense, and the scope of the present invention is defined only by the appended claims.

Within the descriptions of the figures, similar elements are provided similar names and reference numerals as those of the previous figure(s). Where a later figure utilizes the element in a different context or with different functionality, the element is provided a different leading numeral representative of the figure number (e.g, 1*xx* for FIG. 1 and 2*xx* for FIG. 2). The specific numerals assigned to the elements are provided solely to aid in the description and not meant to imply any limitations (structural or functional) on the invention.

It is understood that the use of specific component, material, device and/or parameter names are for example only and not meant to imply any limitations on the invention. The invention may thus be implemented with different nomenclature/terminology utilized to describe the components/material/devices/parameters herein, without limitation. Each term utilized herein is to be given its broadest interpretation given the context in which that terms is utilized.

Several descriptive terms are utilized to describe certain functional characteristics of cue sticks. To facilitate the understanding of the described embodiments of the present invention described below, the following terminology will be used as described below.

(a) Weight: describes the overall weight, as measured in grams (SI units) or ounces (English/American units) of a cue stick, and specifically the cue handle;

(b) Balance: describes the location of the center of gravity of a cue stick along its length, or the weight distribution of a cue stick along its length; according to the design features of the cue handle, balance also accounts for effective mass distribution for an optimal effective center of mass of the completed cue stick when the cue handle is attached to a cue shaft; and (c) Rigidity: describes the amount of stiffness along the longitudinal axis of the cue stick, and specifically the cue handle. This quality measures the amount of load required to be applied perpendicular to the longitudinal axis to cause the cue handle to bend/flex. A rigid cue stick is said to have little flex;

(d) Strength: describes the level of force required that can be resisted before a connecting joint between the cue shaft and cue handle breaks, when the cue stick is subjected to lateral (bending) force. Strength applies primarily to the joint structure at which the cue handle attaches to the cue shaft when assembled.

Additionally, in describing the cue stick handle, relative locations of components are described in terms of a first end at which the joint screw/pin is attached and a second end at which the rubber bumper may be inserted. For clarification, several other terms may also utilized interchangeably with the first end and second end, respectively, as follows: (a) first end, joint pin end, and anterior end all referencing the same general location of the cue handle; and (b) second end, bumper end, and posterior end referencing the same general location of the cue handle. The second or posterior end typically has a larger circumference than the first or anterior end, due to tapering of the cue handle's exterior casing. The first end and second end are described as opposed to each other, meaning that along the longitudinal direction of the cue handle, one end is located at the opposite terminating point/end of the length of the cue handle, pointing in a first direction, relative to the other end, which is located at the next terminating point/end pointing in a second opposite direction. Also, the forearm section of the cue handle is defined as the location along the cue handle, closer to the first/anterior point) end. Specifically, the forearm is the portion of the length of the cue stick handle extending from approximately the joint (pin holder) toward the cue butt, up to the grip hand section (i.e., the location at which the cue handle is typically gripped by a user of the cue stick). The length of the forearm can vary roughly from 40% of the handle length up to 60%, and a substantial portion of the forearm is reinforced with a rigid inner core, according to the described embodiments. However, in alternate embodiments, a different length of the cue handle may be considered the forearm in some cue handle constructions and/or a different length of the cue handle may be provided with a rigid inner core, regardless of the definition of the forearm is such cue handle construction.

Additionally, as utilized herein and in the appended claims, the term "wood" is defined to include naturally fibrous materials such as, but not limited to, hardwoods and bamboo, as well as synthetic fibrous materials having properties similar to wood. Also, the usage of the term "rigid inner core" by itself describes that portion of the complete inner core that is comprised of one single member or of two or more adjoining members, where at least one member exhibits high-rigidity characteristics, similar to steel. The rigid member(s) of the inner core terminate at opposed ends of the cue handle with some mechanism/component (e.g., a joint pin holder and/or a weight-and-balance pin holder) for enabling connectivity to other components at the joint pin end and bumper end of the cue handle. The assembly that includes the connecting mechanism is referred to as a "complete inner core" or "inner core" (see FIG. 4B and description thereof below). Thus, references to "complete inner core" or "inner core" herein generally references the entire section of the cue handle that extends internal to the external casing, including the connecting mechanisms at the end. It is therefore appreciated that the cue handle designs provided by the various embodiments described herein includes an inner core or complete inner core that comprises multiple different components extending from the joint pin to the butt of the cue handle, with each component exhibiting varying functional characteristics along the length of the cue handle. Finally, the term "conical" when utilized to describe the cue handle and portions/segments of the cue handle generally refers to a frustum with a circular base at the butt end of the shaft and tapered circular outer surface area that extends to the joint pin.

With reference now to the figures, FIG. 1 illustrates a perspective (external) view of one embodiment of a cue stick handle (cue handle), designed according to the methods described herein, and as illustrate in the accompanying figures. As shown, cue handle 100 comprises a visible exterior casing (referred to as a casing because the shown exterior structure houses/surrounds internal components, as described below with reference to FIG. 2), having a first/posterior end 120 (right hand side of figure, also referred to as the bumper end or posterior end) and a second/anterior end 130 (left hand side of figure, also referred to as the joint screw end or anterior end) laterally disposed from the first end, and forming a rigid conical structure or circular frustum (see FIG. 4A). The exterior view of cue handle 100 has the appearance of a solid structure comprised of three adjoining segments 106, 107, 108 of different lengths. The adjoining segments are constructed of at least a first "wood-type" material, such as wood, wood fiber, wood veneer, or synthetic wood, for example, to provide the look and feel of wood. The segments 106, 107, 108 extend along the longitudinal axis of the cue handle 100, and are separated at the two connection points by spacers (or rings) 110, 111 made of a different material (or different colored material). Notably, while three segments adjoined with two spaces are illustrated, the number of segments (and corresponding numbers of adjoining spacers) is variable, and can range from a single segment to another larger number of segments, e.g., 2, 4, 5, and so on.

The combination of the above materials in the manner described provides an external appearance of a cue handle 100 that is constructed of solid wood, separated by decorative spacers. As described above, the external casing could also be constructed from a single piece of wood without decorative rings or from multiple pieces/segments of wood. Thus, description of the casing as having three segments with two rings interspaced at the segment's connecting points is provided solely for illustration, and the number of segments (from one to any finite number) and rings (from zero to another finite number) are only relevant to the design/manufacture of the cue handle, with respect to enabling accurate calculation of the weight attributable to the components of the exterior casing components, as well as a determination of the resultant cue stick's center of gravity and effective mass distribution and center of mass when the exterior casing is placed around an interior core structure to form the cue handle.

Figure 4A:
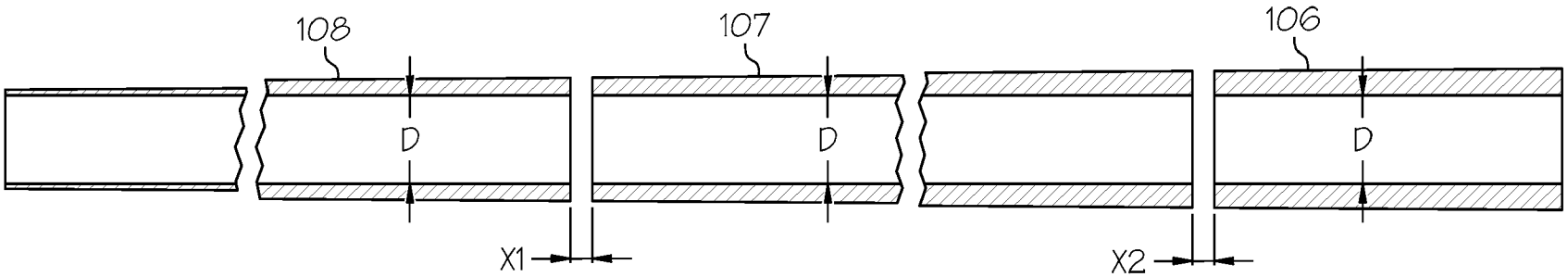
FIG. 4A is a sectional view of the outer casing of the cue handle according to one embodiment of the invention.

Turning now to FIG. 4A, there is illustrated an example design of the three tapered conical segments (i.e., hollow, circular frustums) that make up the external casing of cue handle 100. As shown, each segment 106, 107, 108 is actually a tapered cylinder, with all segments 106, 107, 108 having a consistent bore diameter (D). That is, the cylindrical hole extending through each of the three segments 106, 107, 108 has substantially the same inner diameter (D) and circumference. Notably, the outer circumference of segments 106, 107, 108 is tapered, such that when the segments 106, 107, 108 are aligned next to each other, they provide a consistent tapering of the outer circumference across the three segments 106, 107, 108, while the internal diameter remains consistent. As noted above, the number of segments may range from one to a much larger number, and the description herein of three segments is solely for illustration.

As further illustrated by FIG. 4A, two small spaces x1, x2, interrupt the consistency of the tapered outer edges. These spaces represent the width of the areas along the external casing of cue handle 100 in which the spacers 110, 111 (FIG. 1) are placed between the segments 106, 107, 108. These spacers, which are not shown in this depiction, also have an inner diameter that is substantially the same as the diameter of the three segments 106, 107, 108. Further, the spacers 110, 111 also have a somewhat tapered exterior surface to enable consistent line of tapering between each connection point between the segments.

Two different designs of cue handles are provided by the described embodiments, based primarily on the type and/or construction of the inner core section of the cue handle. Generally, the embodiments are directed to either a first-type cue handle or a second type cue handle, which relates to a corresponding first-type inner core construction and a second-type inner core construction. The below description is thus separated into two main sections, Section A, which describes the first-type cue handle and Section B, which describes the second-type cue handle. The method steps described below are primarily directed to the second-type inner core construction.

As introduced above, the embodiments generally provide a cue stick handle having a longitudinal length extending from a joint screw end to a butt end, where the cue stick handle comprises: a hollow exterior casing comprising one or more rigid, conical members extending along a substantial portion of the longitudinal length; and an inner core that includes a rigid inner core (segment) confined within the hollow exterior casing for a first length between the joint screw end and the butt end. The rigid inner core has certain structural characteristics, including a rigidity that is similar to steel. With these characteristics exhibited by the rigid inner core, the cue handle itself exhibits similar structural characteristics in at least a forearm section of the cue handle. Additional characteristics, such as weight and balance (center of gravity), mass distribution to provide an optimal effective center of mass, as well as joint strength, of the various embodiments of the cure handle are controlled, based on the design of the cue handle and particularly the complete inner core.

A. First-Type Cue Handle (Two-Member Rigid Core Construction)

Figure 2:
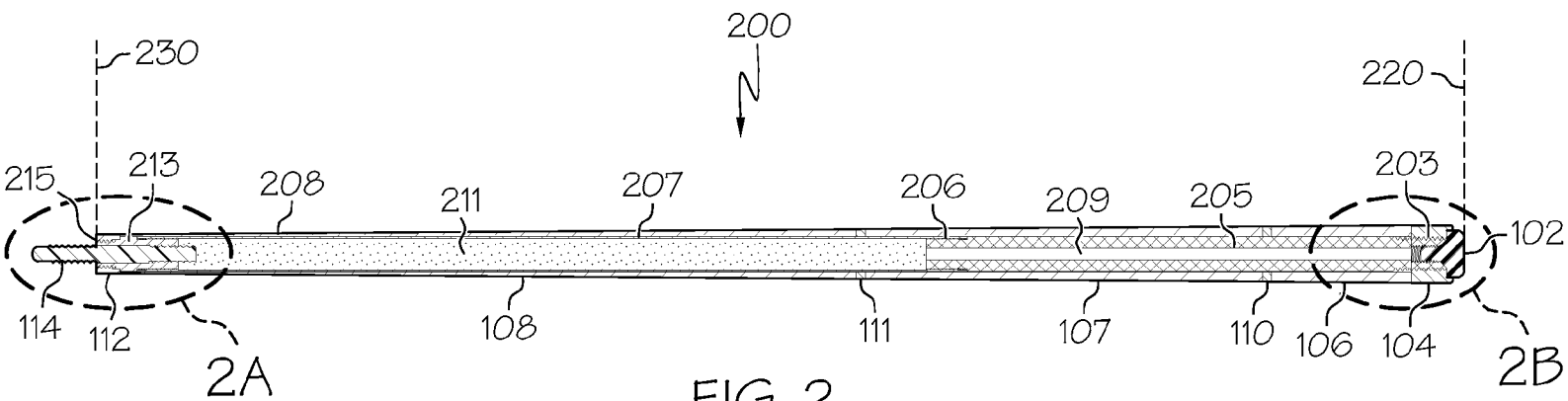
FIGS. 2, 2*a* and 2*b* are cross sectional views illustrating the component makeup of a first-type cue handle with connected, inner core members including a rigid segment and specific sections of the first-type cue handle, in accordance with one embodiment of the invention.

In the first embodiment, which is illustrated by FIG. 2 (including FIGS. 2A and 2B), the two member rigid inner core comprises a rigid metal core insertably coupled to a wood core. Thus, as generally illustrated by FIG. 2, described below, the rigid inner core is a first section of a longer inner core (or complete inner core) that includes two or more linearly interlocked and glued components providing a first threaded end and a second threaded end opposed to the first threaded end. The rigid inner core comprises a metal tube composed of a hard, tensile material that provides steel-like characteristics including rigidity/stiffness. The second portion/segment of the rigid inner core is a wood core, which is securely joined at a first end to the metal tube and has a second posterior end corresponding to the second end of the inner core.

Figure 2B:
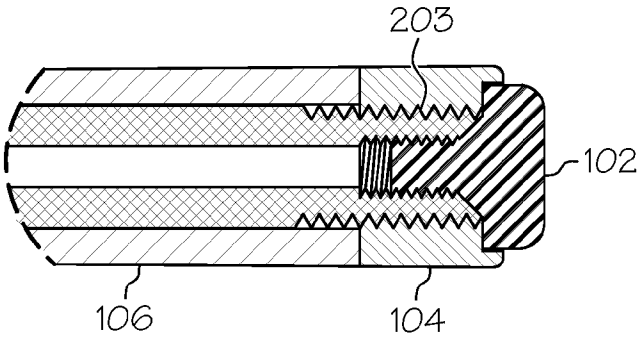
Figure 2A:
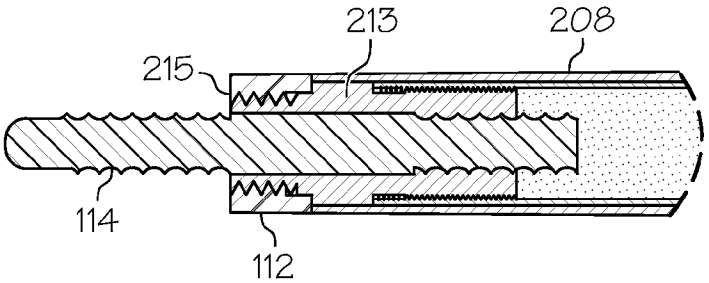

Turning now to FIG. 2, which illustrates a cross sectional view of first-type cue handle 100. FIG. 2 is described with reference to FIG. 1 (introduced above), as well as with specific reference to FIG. 4B, which illustrates the complete inner core construction of the first-type cue handle. Components representing external casing of first-type cue handle 200 are represented by the same reference numerals as FIG. 1 (i.e., reference numerals in the 100 range), while components internal to the casing (primarily inner core components) are represented by reference numerals in the 200 range. As shown, first-type cue handle 200 comprises various components of external casing as well as two adjoining segments making up the rigid inner core, which is coupled to different components at both ends of the cue handle. The combination of the two segment rigid inner core and the components coupled to their respective ends is collectively referred to herein as a complete inner core (see complete inner core 400 of FIG. 4B). FIGS. 2A and 2B illustrated expanded views of sections of cue handle 200 at which the mating (i.e., joining or connecting) of components occur, at the first/posterior end 220 and second/anterior end 230, respectively.

As with the descriptions of FIGS. 1 and 4A above, the illustrated external casing comprises three longitudinal, conical sections 106, 107, 108, separated from each other by spacers 110, 111, for decorative and/or aesthetic purposes. The arrangement of the conical sections and spacers creates an external casing with a hollow, cylindrical, inside surface extending through most of the length of the cue handle 200. The external casing fits around the complete inner core 400 and is securely glued in place over portions of the complete inner core 400, and attached proximate to the ends of the complete inner core 400 via the first and second collars 104, 112, such that the rigid members of the complete inner core 400 are not exposed or visible.

Within the description of FIG. 2, the segments of external casing are assumed to be wood. Thus, the external casing comprises one or more pieces of tapered, conically shaped wood, having an internal diameter (D) that is marginally larger than the outer diameter (D−d) of the complete inner core 400. With this small delta in the complete inner core's outer diameter, a near fit occurs when the external casing is placed over the complete inner core 400 and/or when the complete inner core 400 is placed within the external casing. In one embodiment, the external casing also comprises one or more plastic or composite spacers/rings 110, 111 separating the individual pieces of tapered, cylindrically shaped wood, such that the continuity of the exterior wood on the cue handle 100 is broken.

When the individual components of the external casing are assembled together, they create an external shaft having a longitudinal cavity disposed between the first end 220 and the second end 230, through which the complete inner core 400 extends. The length of the longitudinal cavity may vary, depending on certain desired characteristics (such as overall weight, balance, and feel) of the cue handle (or cue stick assembled with the cue handle and a cue shaft). With this consideration of desired characteristics, the length and type of the various materials used for each component is factored into the design analysis, as described further below.

Returning now to FIG. 1, the first end 120 of the cue handle 100 includes a first collar 104, fixedly attached to the end of the first segment 106 away from the point of connection with the first spacer/ring 110 and/or the second segment 107. The first collar 104 is made of a third material, which may be similar to the second material. A resilient bumper 102, made of rubber, plastic or composite material is removably inserted into a (threaded) hole within the first end 120 of the cue handle 100. The bumper 102 is inserted flush against the edge of the first collar 104, which edge is opposite the second edge of the first collar 104, which is glued to the first segment 106.

A second collar 112 is affixed at the anterior end of the third segment 108, furthest away from the point of contact with the second spacer/ring 111 and/or the second segment 107. The second collar 112 may be made from the third material, which may again be similar to (or the same as the second material). Protruding from the second end 130 of the cue handle 100 is a metal pin or screw, with connecting means for inserting the tip of the pin into a receptacle or hole, such as exists at the mating end of a cue shaft (see FIG. 5). The metal pin (114) shall hereinafter be referred to as joint pin 114 (or joint screw 114) and represents the mechanism by which cue handle 100 attaches to a cue shaft.

As introduced above and illustrated by FIGS. 2 and 4, cue handle 200 comprises complete inner core 400, having a plurality of linearly interlocked/connected components. According to the illustrative embodiment, each component is made of a different material, specifically selected to provide certain desired functional qualities in the cue handle 200. Complete inner core 400 has a first/posterior end (220) and a second/anterior end (230), opposed to the first end (220). Complete inner core 400 also has a joint pin 114 extending externally from/through the second end (230).

Extending from the first end (220) to a first connecting joint 206 is wood core segment 205, made of wood or other material exhibiting similar performance characteristics. Wood core segment 205 may be solid or hollow. At the end proximate to the first end 220 of cue handle 200, wood core segment 205 is coupled to a first collar 104 via a coupling mechanism, such as a first-type threading surface (e.g., male threads), rotatably mated to a second-type threading surface (e.g., female thread).

FIG. 2B provides an expanded view of the connectivity of the various components at the first end 230 of cue handle 100. At the first end (106) of the external casing, corresponding to the first end 230 of the complete inner core 400, first collar 104, made of plastic, metal, wood, or other material, is affixed to the wood core segment 205. The first collar 104 is substantially cylindrical with an inner cylindrical space provided through the first collar 104 of relative dimensions to fit over the end of the wood core segment 205.

The wood core segment 205 is joined and/or affixed (e.g., threaded and glued) at the first joint 206 to a hollow rod/tube made of a hard, tensile material. In the described embodiment, the rod/tube (207) is made from a metal, such as steel, or other metallic substance exhibiting characteristics similar to steel, or other rigid/stiff metal. For simplicity, the rod/tube is referred to herein as a metal tube 207. Metal tube 207 has a first end, which is adhesively coupled/attached to wood core segment 205 at first joint 206.

Use of this tube in the manner illustrated and described provides a level of stiffness extending from the second joint to the point at which a user holds the cue handle. The level of stiffness is on the order of four times the relative stiffness of a conventional wooden handle, with a wood core. In yet another embodiment, a carbon fiber composite is utilized in place of the metal tube. The metal tube 207 has a length Y, which according to the illustrative embodiments, is less than the full length of the inner core 400.

At the second end of the metal tube 207, disposed longitudinally from the first joint 206 and corresponding to the second end 230 of cue handle 200, metal tube 207 is coupled at a second joint 208 to a very strong fiber glass epoxy material (i.e., a strong composite material) via a coupling means (e.g., use of a strong bonding agent placed on one or more connecting surfaces). FIG. 2A provides an expanded view of the connectivity of the various components at the first/anterior end 230 of cue handle 200. The epoxy material is referred to herein as pin holder 213, and serves as an attachment to the metal tube 207 within which a first end of joint pin 114 is inserted. Pin holder 213 is made up of a material that has a high tensile and bending strength. In one embodiment, the modulus of elasticity of pin holder 213 is on the range of one third that of steel. Pin holder 213 provides a solid center joint, with strength substantially higher than that of wood, and approaching the strength of steel but without being as heavy as steel. Thus, unlike the conventional joints with single metal bolts to enable the coupling of the handle to the shaft, use herein of the pin holder 213 provides enhanced strength at the joint.

Pin holder 213 also provides an extended end (opposed to the end couple to the metal tube) to which second collar 112 may be coupled. An exposed end of the joint pin 114 protrudes from pin holder 213 of complete inner core 400. The exposed end of joint pin 114 is provides a joint screw at which a cue shaft may be readily engaged and disengaged (or permanently affixed—with adhesives) from/to the cue handle 200, and vice versa.

In an alternate embodiment, the joint pin is not securely fastened to the joint pin holder. Rather, the joint pin is attached to a cue shaft and the joint pin may then be insertably attached to the cue handle when the cue handle is being combined with the cue shaft to complete a cue stick. With this embodiment, the joint pin holder still has an axial bore for receiving a joint pin from a cue shaft, but no joint pin is securely attached within the axial bore, except when the cue shaft in attached.

In one embodiment, the metal tube 207 includes therein a (pliable) filling substance/material 211 extending from the first joint 207 to the second joint 208. The (pliable) filling substance/material 211 doubles as a vibration-dampening material. The filling material 211 preferably has a high surface area that diffuses reflections and attenuates the linear vibrations (up and down the length of the metal tube) as the vibrations reflect off the surface. The filling material also has a rubber-like consistency, and the material also has significant mass. Given these characteristics, filling material may be preferably made of a relatively heavy foam rubber. A non-exhaustive list of possible filling material 211, includes, but is not limited to, cork, foam, sponge, rubber and balsa wood.

The second collar 212 may be made of similar material as the first collar 204 and is screwed and glued on to the exposed threading of the pin holder 213. The second collar 212 is also substantially cylindrical with an inner cylindrical bore provided through the second collar 212, with dimensions to fit over the exposed threading of the pin holder 213, when affixed thereto.

In yet another embodiment, the cue stick may be designed with multiple segments, each have different characteristics. As an example, the cue stick may comprise four quadrants, with one quadrant within the cue handle, representing the forearm portion of the cue stick, being made of the rigid material (or having a rigid inner core) with the characteristics of the metal tube 207, as described herein.

Figure 6A:
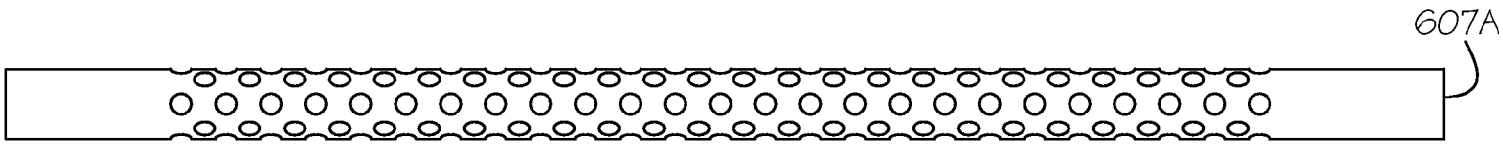
FIG. 6 is a sectional view of the rigid inner tube of the cue handle's inner core with multiple perforations (holes) to reduce density and/or weight within sections of the cue handle, in accordance with one embodiment of the invention.
Figure 6B:
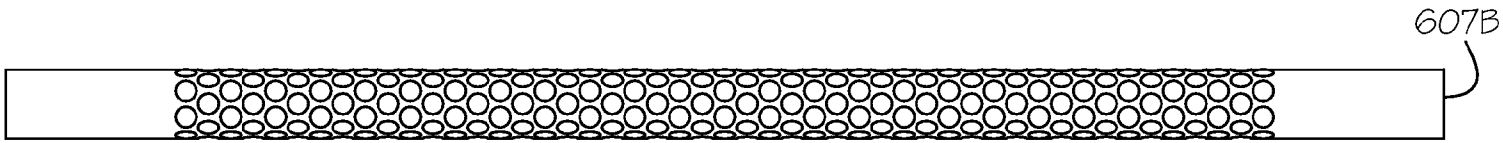

With reference now to FIG. 6, which illustrates an example inner metal tube 607 designed with holes within the surface. In the illustrative embodiment, the metal tube 607 is perforated (with holes) to reduce the effects of weight due to the density of the hard, tensile material from which the tube is made. The perforated design of the metal tube 607 enables greater control in the weight (per linear dimension/length) of the metal tube 607 and ultimately enables the cue handle to be designed with different exterior material, while also providing greater flexibility in determining a center of gravity and balance of the cue stick, as well as other functional benefits, all while maintaining the rigidity of the forearm section.

To maintain structural integrity along the longitudinal axis, the holes are arranged in a set pattern relative to each other. As illustrated with tube 607*a*, representing a first embodiment, substantially one half of the holes are arranged at 0, 90, 180, and 270 degrees, relative to a 0 degree (start) reference point. The remaining holes (i.e., the second half of the holes) are arranged (or made) at 45, 135, 225, and 305 degrees relative to the 0 degree reference point. In tube 607*b*, which providing a second embodiment, the holes are drilled at a smaller spacing around the diameter of the tube 607*b*. Thus, substantially one half of the holes in tube 607*b* are arranged (made) at 0, 45, 90, 135, 180, 225, 270, and 315 degrees, relative to a 0 degree (start) reference point. The remaining holes are arranged (or made) at 22.5, 67.5, 112.5, 157.5, 202.5, 247.5, and 292.5, and 337.5 degrees relative to the 0 degree reference point. The number of holes and the hole positions relative to each other is a design factor that is variable.

A.2 Example Method for Constructing a First-Type Cue Handle

Figure 4B:
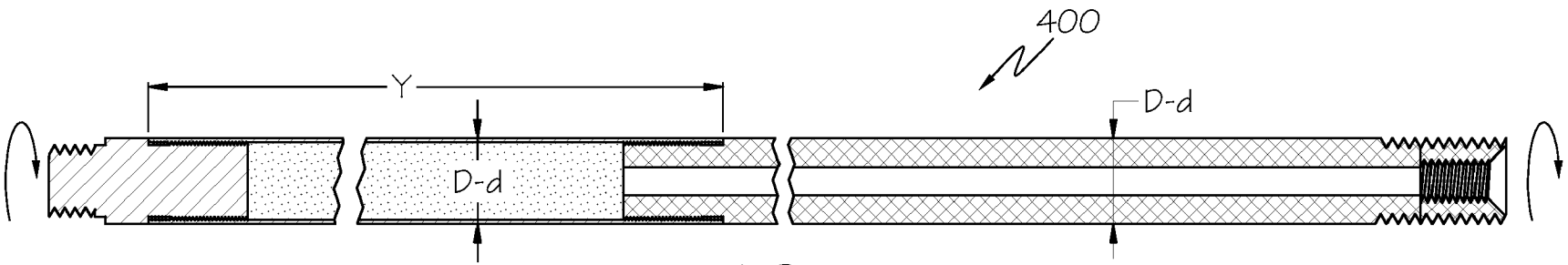
FIG. 4B is a sectional view of a two-member, connected, rigid inner core of the cue handle, according to one embodiment of the present invention.

A method of making the above cue handle and cue stick and certain components thereof comprises a series of steps, which entails manufacturing the above handle in portions and then connecting or affixing and/or gluing the various portions together. According to one embodiment, and as illustrated by FIGS. 4A and 4B, the individual components of the inner core 400 are manufactured according to pre-calculated dimensions, taking into consideration the relative weight of the wood (or other material) being utilized for the segments of the external casing. Certain physical characteristics, such as the bore of each component, width of the walls, the interior and exterior circumference of the inner wood core segment and of the metal tube, length of the segments relative to each other, the final dimensions of the cue handle, and the weight-balance-mass distribution characteristics desired, among others, are factored into the design of each of the multiple components. The individual components, and ultimately the cue handle, are thus engineered to account for the weight of all the materials in the final product and the placement and structure of specific materials to account for a pre-determined or desired center of gravity, mass distribution, overall weight, rigidity of the forearm, and other characteristics that affect the cue stick's playability. For example, the length of the metal tube may be adjusted to account for density of the exterior wood. As another example, in one embodiment, a combination of a carbon fiber tube and metal tube may be utilized in lieu of a single metal tube to provide greater flexibility of balance point determination, weight, and precision with respect to the cue handle's diameter size.

Once manufactured, the components of the complete inner core are assembled as shown in FIG. 4B. The assembly includes affixing the particular components to each other at the two joints via some form of coupling mechanism (e.g., utilizing high strength adhesive). Notably, as described below, the second-type cue handle comprises only a single, continuous, rigid metal tube as the rigid inner core. This single metal tube may be designed with holes to provide correct balance (with considerations of effective mass distribution for an optimal, effective center of mass) and weight characteristics as shown by FIG. 6. This embodiment eliminates the need for a separate wood segment and an fixed joint between the segments.

One example method by which the first-type cue handle described herein is manufactured is now presented. With the inner core dimensions established (length, diameter, weight, and circumference), the piece(s) of wood utilized to create the external casing is/are drilled to create an internal bore with consistent circumference. According to the illustrative embodiments, the longitudinal, external diameter ($D-\delta$; where D represents diameter and $\delta$ represents a delta that is subtracted from the value of D) of the inner core is minimally smaller than the longitudinal inner diameter (D) of the external casing. This is required so that the external casing may be placed over the inner core during assembly, but with just enough space to allow the connection between the inner core's external surface and the internal surface of the external casing is completed with little or no gaps between the surfaces. In one embodiment, for example, the external diameter of the inner core may be in the range of 95-97% of the inner diameter of the external casing. Finally, the first and second collars are placed over/on the first end of the wood core and the protruding extended end of the pin holder, respectively.

In one embodiment, the external, longitudinal surface of the inner core, and the internal, longitudinal surface of the exterior casing components are coated with an adhesive, such as epoxy resins, polyvinyl acetates, or polyurethane, for example. This non-exhaustive list of adhesives is provided solely for example, and not intended to limit the implementation of the method described herein to these small list of example adhesives. With the inner surface wet with the adhesive, the component parts of the external casing are slid on to the inner core, and then the first and second collars are screwed on to the respective threaded ends and tightened. The top collar and bottom collar are rotated to a tightness at which all connecting surfaces are flush against each other and extra adhesive is pressed out of the joints. All connecting pieces are squared relative to each other, and specifically the adjacent, connected pieces. The extra adhesive is wiped off of the external casing. The cue handle is then left for the adhesive to cure.

Once the adhesive cures, the external casing is rounded into the required shape using a lathe or other cutting or sanding tool to provide smooth consistency in the tapering of the various adjoining components of the external casing. The diameter of the components may be decreased by the use of a lathe to a predetermine size and to provide a substantially smooth exterior surface. Once the cue handle reaches the desired shape, weight, look, and consistency, the rubber bumper is inserted (pressed or screwed) into the internal anchoring space in the exposed end of the wood core segment. In one embodiment, the cue handle may be additionally covered by an outer veneer or sleeve comprising decorative material.

It should be understood that the above method is one embodiment of many which may be utilized to manufacture and/or construct a cue handle having the characteristics described herein. The description of one such method is therefore not intended to be limiting on the invention, which generally covers all cue handles which exhibit the features described herein, and particularly the rigidity of the forearm by inserting a rigid inner core as a part of a complete inner core, which extends through the cue handle and multiple, different portions that each exhibit different characteristics and/or functionality. The invention this covers any such cue handle, regardless of the type of manufacture/construction method(s) utilized.

In one embodiment, the rubber bumper and spacers/rings may be provided solely for cosmetic purposes or aesthetic appeal. In another embodiment, given the potential to create different weight and balance points for the cue handle based on selected design characteristic, the location and or color of the spacers and/or the color of the rubber bumper may be utilized to provide/described additional functional features of the cue handle and/or cue stick, while providing aesthetic appeal. For example, different colors may be used for the rubber bumpers, where the color of the inserted rubber bumper defines the play characteristics such as weight and balance of the cue handle. This distinction would then be based on design controls, which is influenced by the types of materials utilized, the length of the metallic tube relative to the total length of the cue handle or to the inner wooden core, and the weight of the wood utilized for the external casing, among other design parameters and/or factors.

B. Second-Type Cue Handle (Single Member Rigid Core Construction)

According to a first embodiment, the rigid inner core of the second-type cue handle is a single-member inner tube, made of a hard, tensile material that provides steel-like characteristics, including rigidity. In one implementation the inner tube is a metal tube, and in one embodiment of that implementation, the metal tube is a steel tube. Thus, the inner core comprises a single rigid, metal tube with a first end disposed proximate to the posterior end of the cue stick handle and a second, opposing end disposed proximate to the anterior end of the cue stick handle.

Figure 3:
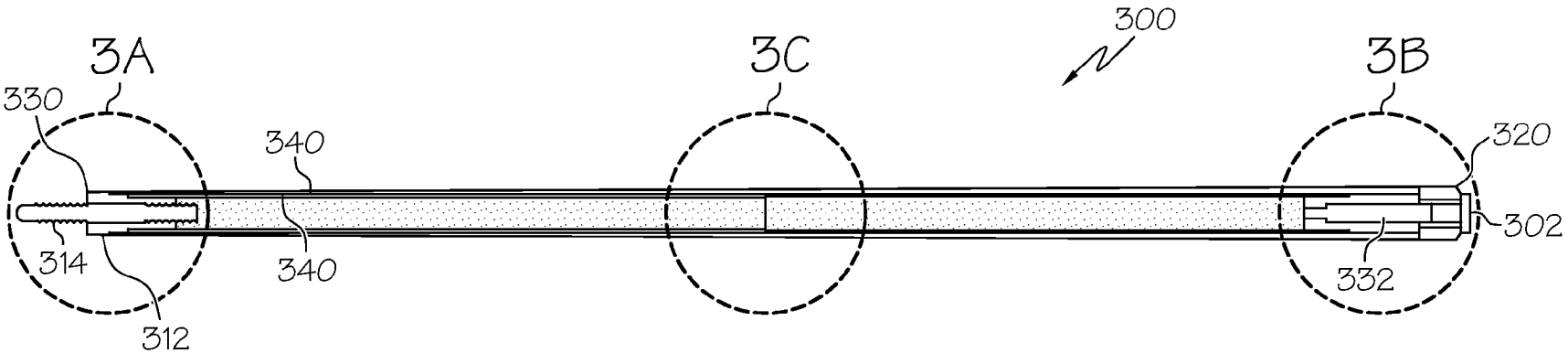
FIGS. 3, 3*a*, 3*b* and 3*c* are cross sectional views illustrating the component makeup of a second-type cue handle with a rigid inner core and specific sections of the second-type cue handle, in accordance with one embodiment of the invention.
Figure 3A:
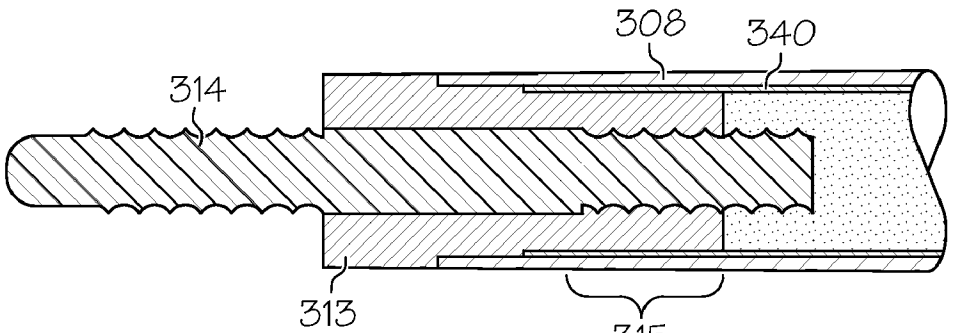
Figure 3C:
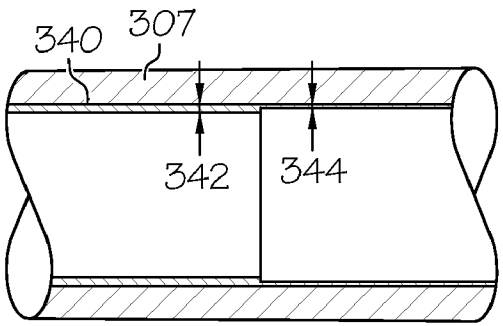
Figure 3B:
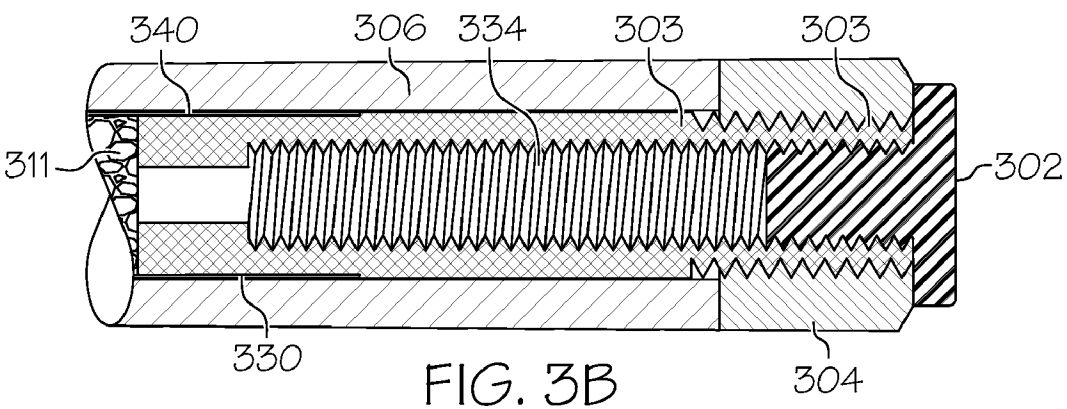

With reference now to FIG. 3 (and associated FIGS. 3A, 3B and 3C), there is illustrated a cross sectional view of a second-type cue handle comprising a second-type, rigid inner core constructed from a single metal tube, with a rigidity similar to that of steel. FIGS. 3A and 3B illustrated expanded views of sections of second type cue handle 300 at which the mating (i.e., joining or connecting) of connecting mechanisms and other inner core segments and/or components occur, respectively, at the first/anterior end 330 and second/posterior end 320 of the complete inner core. FIG. 3C illustrates an expanded view of a section of the single rigid inner core at which a change is made in the diameter of the bore, as a design feature.

In one embodiment, the metal tube is a steel tube that is manufactured with a specific bore and with specific dimensions for utilization as the inner core of the second-type cue handle. As shown, the longitudinal cross section of second-type cue handle 300 comprises the connected segments/components of external casing and a single rigid tube-like inner core, which is coupled to different connecting mechanisms at opposed ends of the cue handle. The combination of the connecting mechanisms coupled at respective ends to the single member, rigid inner core is collectively referred to herein as a complete inner core. However, portions of the connecting mechanisms protrude beyond the point at which the rigid inner core stops. In the illustrative embodiment, both of the connecting mechanisms extend laterally past the external casing.

As illustrated by FIG. 3, the single rigid inner core is a (metal) tube 340 that extends from the posterior end 320 to the anterior end 330 of the cue handle 300 and terminates at the connecting ends with a first connecting mechanism at the joint end of the cue handle 300 and a second connecting mechanism at the butt end of the cue handle 300. The first connecting mechanism is referred to herein as a joint pin holder 312, while the second connecting mechanism is referred to as a weight-and-balance screw holder 333. The functionality of each connecting mechanism, which is directly related to the names attributed to each mechanism, will be described with specific reference to FIGS. 3A and 3B, respectively.

While shown as extending a significant length of cue handle, other embodiments of the second-type cue handle may provide for a much shorted length of metal tube (340), extending primarily within the forearm section of cue handle. The remaining length of inner core may then be replaced with a rigid/hard wood segment or an extension provided by some other material other than tube (340). In one alternate embodiment, the metal tube 340 is designed to act as a through bolt with grooved/threaded ends that enable a screw-on cap to be threaded on to the butt end and a pin holder to be screwed-on to the joint end.

Turning now to FIG. 3A, which illustrates the connecting joint at which joint screw 314 is insertably coupled to joint pin holder 313, which is itself coupled to metal tube 340. In the provided embodiment, joint pin holder 313 includes a posterior portion/end, which is coupled/attached to the anterior end of metal tube 340. The mechanisms for coupling the two components may include a strong glue or epoxy and/or a thread mated with each other to ensure a rigid solid construction. As shown, pin holder provides an exposed end, opposed to the end coupled to metal tube 340. The exposed end has a larger exterior diameter with one surface facing the external casing 308 and providing a shoulder to buttress the edges of the adjacent segment of external casing 308. This construction of point) pin holder 313 affixed to the end of the rigid inner core, where the complete inner core then extends and provides an attachment (for the second collar 304) at the opposing end, enables the exposed end of the pin holder 313 to serve as the head of a bolt. During final stages of construction, a collar 304 is tightened onto the butt end of the bolt to hold the various components securely in place. Joint screw/pin 314 has an exposed end extending laterally from the pin holder 313. In one embodiment the exposed end has radial threads for insertably coupling cue handle 300 to an appropriately-dimensioned female receptacle of a cue shaft. According to one embodiment, pin holder 313 is made of a phenolic, and may be either a canvas based phenolic or a linine based phenolic.

In an alternate embodiment, the joint pin is not securely fastened to the joint pin holder. Rather, the joint pin is attached to a cue shaft and the joint pin may then be insertably attached to the cue handle when the cue handle is being combined with the cue shaft to complete a cue stick. With this embodiment, the joint pin holder still has an axial bore for receiving a joint pin from a cue shaft, but no joint pin is securely attached within the axial bore, except when the cue shaft in attached.

FIG. 3B provides an illustration of one method by which weight-and-balance screw holder 333 is coupled to metal tube 340 to provide the connective mechanism for completing the but end of cue handle 300, in one embodiment. Weight-and-balance screw holder 332 comprises a first (anterior) connecting surface that is coupled to a metal tube 300 at the posterior end of metal tube. Weight-and-balance screw holder 332 also comprises an axial bore. A posterior end of weight-and-balance screw holder 332 is exposed with a connecting surface 303, which serves as the surface to which second collar 304 is coupled/attached. One segment of external casing 306 covers the connecting joint as well as the extended portion of weight-and-balance screw holder 332 up to the point of connection of the second collar 304.

Metal tube 340 is drilled with a lathe or other cutting device to remove a substantial portion of the wall thickness and weight. This enables control of the total weight and center of mass (and mass distribution) during the design/manufacturing process. In one implementation, the resulting metal tube may have an outside diameter of 0.75 inches and an internal diameter of 0.68 inches. Of course, embodiments of the invention may be implemented with metal tubes having different inner and outer diameters, and the above example diameter measurements are provided solely for illustration and not intended to limit the invention. According to the illustrative embodiment, and as further depicted by FIG. 3C, the inner diameter of metal tube 340 may be variable, with some portions having a first inner diameter and other portions having a different inner diameter. As shown, the inner anterior portion of metal tube 340 has a first diameter 342, which is smaller than second diameter 344 of the inner posterior portion of metal tube 340. This deliberate reduction in the thickness of the walls (resulting from the increase in the interior diameter) of metal tube 340, at the butt end of cue handle 300, results in decreased weight, while maintaining the rigidity desired in the forearm of the cue handle. Thus, the rigidity associated with the metal tube 340 remains substantially on the order of one third the rigidity associated with a solid steel rod of the same outside diameter.

The resulting decrease in weight of the metal tube 340 (after cutting or scurrying away wall thickness) within the design process enables greater control of the weight of the cue handle, and further enables weight and balance (and mass distribution for an optimal center of mass) determinations to be made post manufacture/design. Looking again at FIGS. 3 and 3B, in one embodiment, at least some portion of metal tube 340 is filled with vibration dampening/absorbing material 311, which may comprise any of the aforementioned dampeners, such as sound dampening foam.

According to one implementation and as shown by FIG. 3B, an internal/axial chamber is provided within weight-and-balance screw holder 332. In one embodiment, this axial chamber can be utilized by the manufacturer and/or user of cue handle 300 to selectively insert a weighted bolt/screw 334 inside of the axial chamber within the weight-and-balance screw holder 333. The weighted bolt/screw may be of a predefined weight and capable of adjusting the overall weight of the assembled cue stick by a measurable percentage (e.g., +/−10%). Rubber bumper 302 is inserted into the open end of weight-and-balance screw holder 332, thus completing the finished look of the cue handle 300. As shown, both weight screw/bolt 334 and rubber bumper 302 are rotatably inserted into the threaded inner surface of weight-and-balance screw holder 333, while collar 304 is screwed on to the exposed external grooves/threads 303 of weight-and-balance screw holder 333.

C. Cue Stick and Play Characteristics

When constructed in either of the above manners, both first-type and second-type cue handles provide an inner core construction that provides a rigidity that is on the range of 5 times more rigid than hardwood maple or ash, which are commonly utilized within convention cue handle designs.

Figure 5:
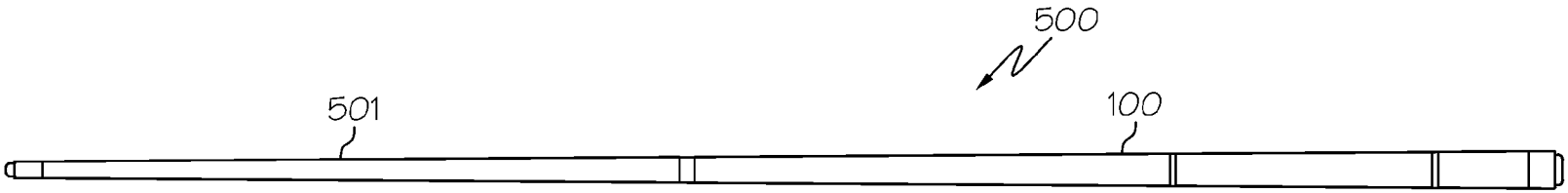
FIG. 5 illustrates an example cue stick complete with the cue handle of FIGS. 1 and 2 or 3, which has been attached to a cue shaft via a joint pin (screw) affixed to a pin holder with high tensile strength, in accordance with one embodiment of the invention.

As shown in FIG. 5, once manufacture is competed, cue handle 200 may be attached to any one of the available cue shafts 501 to provide a complete cue stick 500. Preferably, the cue shaft utilized is a cue shaft (501) designed according to U.S. Patent Application No. 2006/0205525, of common inventorship herewith. Relevant content of that patent application is incorporated herein by reference. With the cue handle 100 designed according to embodiments of the current invention, the cue stick 500 exhibits minimal flex in the axial direction. The axial stiffness serves to maintain satisfactory transmission of momentum axially when the cue stick 500 strikes a ball.

Further, given the specific designs of the cue handle, the cue stick would exhibit several desired functional characteristics, such as: (a) predictable and/or optimal weight and balance (or center of gravity) and mass distribution; (b) radial consistency (feel and performance); (c) vibration dampening; (d) high tensile strength; (e) stiffness/rigidity along the forearm section of the cue handle; and (f) simplicity of assembly. Further, regardless of the specific design of the cue handle, the handle provides the look and feel of solid wood, while playing with the strength and durability and other functional characteristics (typically attributable to metallic substances, such as steel) that are desired, but only attainable using the designed described herein.

While the invention has been described with reference to exemplary embodiments, it will be understood by those skilled in the art that various changes may be made and equivalents may be substituted for elements thereof without departing from the scope of the invention. In addition, many modifications may be made to adapt a particular system, device or component thereof to the teachings of the invention without departing from the essential scope thereof. Therefore, it is intended that the invention not be limited to the particular embodiments disclosed for carrying out this invention, but that the invention will include all embodiments falling within the scope of the appended claims. Moreover, the use of the terms first, second, etc. do not denote any order or importance, but rather the terms first, second, etc. are used to distinguish one element from another.

While the invention has been particularly shown and described with reference to a preferred embodiment, it will be understood by those skilled in the art that various changes in form and detail may be made therein without departing from the spirit and scope of the invention.

What is claimed is:

1. A cue stick handle having a longitudinal length extending from a joint screw end to a butt end, said cue stick handle comprising:

a hollow exterior casing comprising one or more rigid, conical members extending along a substantial portion of the longitudinal length;

an inner core constructed with a plurality of interconnected components, including a rigid inner core confined within the hollow exterior casing for a first length that is less than a total length of the inner core and that extends between an anterior end, which is proximate to the joint screw end, and an opposed posterior end, which is proximate to the butt end, wherein said rigid inner core is made of a hard, tensile material that has structural characteristics of rigidity that are substantially similar to steel and enables the cue stick handle to exhibit such structural characteristics in at least a forearm section of the cue handle, while other components of the inner core exhibit different structural and functional characteristics; and wherein the interconnected components are linearly coupled via one or more mechanisms at the anterior end and the posterior end of the rigid inner core, said mechanisms enabling a substantially permanent attachment of the rigid inner core to other components and includes one or more of (a) threaded grooves on end surfaces of the rigid inner core interlocked with threads on a portion of a component attached to the respective end surface of the rigid inner core, or vice versa; and (b) a mastic applied between connecting surfaces of the rigid inner core and adjacent surfaces of a component coupled to the connecting surface.

2. The cue stick handle of claim 1, wherein the interconnected components comprise:

a joint pin holder composed of a strong composite or plastic material, having high tensile and high bending strength, and which is coupled via a first portion to the anterior end of the rigid inner core and which includes a second portion opposed to the first portion that has a laterally extended surface and a bore extending through the first portion and the second portion; and a joint pin having a first end securely inserted within the bore of the pin holder and an exposed, second end that extends in an axial direction away from the pin holder and the rigid inner core, wherein said joint pin is made with one of a hard metal, a hard metal-like material, fiber glass, or carbon fiber composite, and provides a connecting point at which a cue shaft may be readily engaged to and disengaged from the cue stick handle;

wherein the joint pin holder is made of a material that includes at least one of a composite, fiber glass epoxy material or a phenolic, which material exhibits strength substantially higher than wood to provide enhanced strength at a joint of the cue handle and enhanced strength of a resulting cue stick when a cue shaft is attached at the joint pin.

3. The cue stick handle of claim 1, wherein the interconnected components comprise:

a weight-and-balance pin holder having an anterior portion and a posterior portion with an inner axial bore extending along the center of the weight-and-balance pin holder, said weight-and-balance pin holder being coupled at the anterior portion to the posterior end of the rigid inner core, and wherein said weight-and-balance pin holder enables selective insertion of a weight-and-balance adjustment pin inserted into the inner axial bore of the weight-and-balance pin holder.

4. The cue stick handle of claim 3, further comprising:

a weight-and-balance adjustment pin inserted into the inner axial bore of the weight-and-balance pin holder, wherein a specific weight-and-balance adjustment pin is selected based on a consideration of distributed weight, balance, and effective center of gravity desired for the cue stick handle when assembled with a cue shaft to form a cue stick; and a tightening mechanism affixed to the posterior portion of the weight-and-balance pin holder and which securely fastens internal and external components of the cue stick handle and substantially eliminates movement of the internal and external components relative to each other.

5. The cue stick handle of claim 4, wherein:

the rigid inner core has an axial bore within at least one of the anterior end and the posterior end; and at least one interconnected component is coupled to the rigid inner core via insertion of an extended portion of the at least one interconnected component into the axial bore at a corresponding end of the rigid inner core.

6. The cue stick handle of claim 1, wherein the rigid inner core is a steel tube.

7. The cue stick handle of claim 1, wherein the rigid inner core comprises a rigid tube and the axial bore extends through the entire length of the rigid tube.

8. The cue stick handle of claim 7, wherein the rigid inner core further comprises a pliable filling material disposed within the rigid tube, which provides noise and vibration-dampening during use of the cue stick handle, wherein the filling material has a rubber-like consistency and significant mass.

9. The cue stick handle of claim 7, wherein a wall of the rigid tube is perforated with multiple holes to enable control of weight characteristics of the rigid inner core and the cue stick handle.

10. A cue stick handle having a longitudinal length extending from a joint screw end to a butt end, said cue stick handle comprising:

a hollow exterior casing comprising one or more rigid, conical members extending along a substantial portion of the longitudinal length; and an inner core constructed with a plurality of interconnected components, including a rigid inner core confined within the hollow exterior casing for a first length that is less than a total length of the inner core and that extends between an anterior end, which is proximate to the joint screw end, and an opposed posterior end, which is proximate to the butt end, wherein said rigid inner core is made of a hard, tensile material that has structural characteristics of rigidity that are substantially similar to steel and enables the cue stick handle to exhibit such structural characteristics in at least a forearm section of the cue handle, while other components of the inner core exhibit different structural and functional characteristics;

wherein the rigid inner core comprises a rigid tube;

wherein a relative thickness of a wall of the rigid tube is less at the posterior end of the rigid tube than at the anterior end of the rigid tube.

11. A cue stick comprising:

a cue handle designed according to claim 1; and a cue shaft having a first end and a second end disposed from the first end, said first end having a tip for striking a cue ball, and said second end having one of:

a receptacle for receiving an insertion of a joint pin extending from an anterior end of the inner core of the cue handle; or a joint pin extending from the second end and being utilized to insertably attach the cue shaft to the cue handle, wherein the cue handle includes a join pin holder with an axial bore for receiving a joint pin from a cue shaft.

12. A cue stick comprising:

a cue handle designed according to claim 2; and a cue shaft having a first end and a second end disposed from the first end, said first end having a tip for striking a cue ball, and said second end having a receptacle for receiving an insertion of the joint pin.

* * * * *